US006108825A

United States Patent [19]

Bell et al.

[11] Patent Number: 6,108,825

[45] Date of Patent: Aug. 29, 2000

[54] PROTECTION OF HUMAN HEAD AND BODY

[75] Inventors: Sandra J. Bell; David J. Townend, both of Farnborough, United Kingdom

[73] Assignee: The Secretary of State for Defence in Her Britannic Majesty's Government of the United Kingdom of Great Britain and Northern Ireland, Farnborough, United Kingdom

[21] Appl. No.: 09/101,277

[22] PCT Filed: Jan. 30, 1997

[86] PCT No.: PCT/GB97/00263

§ 371 Date: Jul. 8, 1998

§ 102(e) Date: Jul. 8, 1998

[87] PCT Pub. No.: WO97/27770

PCT Pub. Date: Aug. 7, 1997

[51] Int. Cl.[7] ..... A41D 13/00

[52] U.S. Cl. ..... 2/455; 2/412; 2/16; 428/218; 428/316.6

[58] Field of Search ..... 2/455, 410, 411, 2/412, 414, 16, 18; 428/316.6, 218

[56] References Cited

U.S. PATENT DOCUMENTS

| | | | |
|---|---|---|---|
| 3,506,980 | 4/1970 | Aileo | 2/209 |
| 5,338,599 | 8/1994 | Barrett | 428/212 |
| 5,537,687 | 7/1996 | Garza . | |
| 5,673,437 | 10/1997 | Chase et al. | 2/167 |
| 5,882,776 | 3/1999 | Bambara et al. | 428/215 |
| 5,920,911 | 7/1999 | Cushman | 2/209 |
| 5,938,878 | 8/1999 | Hurley et al. | 156/219 |
| 6,033,756 | 10/1997 | Handscomb | 428/138 |

FOREIGN PATENT DOCUMENTS

| | | |
|---|---|---|
| 0 564 249 | 10/1993 | European Pat. Off. . |
| 2 249 942 | 5/1992 | United Kingdom . |
| WO 96/35342 | 11/1996 | WIPO . |

*Primary Examiner*—Michael A. Neas
*Attorney, Agent, or Firm*—Nixon & Vanderhye P.C.

[57] ABSTRACT

A protective material and a method for the protection of the human head or body from soft tissue damage caused by an impacting object comprises at least two layers of viscoelastic polymeric material to be interposed between head or body and impactor, including at least one first layer of material substantially matched in acoustic impedance to the impacting object and at least one second layer of material selected to produce a large mismatch in acoustic impedance between the first layer and the human head or body. A particular aspect applies the invention to head protection, especially in boxing and like sports, in the form of boxing head guards and boxing gloves.

9 Claims, 2 Drawing Sheets

PROTECTION OF HUMAN HEAD AND BODY

BACKGROUND OF THE INVENTION

1. Field of the Invention

The invention relates to a material and methodology for the protection of the human head and body from soft tissue damage resulting from impulsive loading as a result of blunt object impacts. A particular aspect of the invention relates to a material and methodology for the reduction of head injuries during boxing, and to headgear and boxing gloves employing such material.

2. Discussion of Prior Art

The reduction of injury resulting from the effect of head and body impacts has been the subject of research for many years, particularly in the fields of automotive and military research. One commonplace strategy to mitigate the effect of impact on the body is to interpose a layer of protective material between the body and the source of impact. This is especially so in relation to head injuries, with head protection provided in the form of a helmet.

Protective materials have to date generally been developed with a view to minimising the gross displacement of the head or body produced by blunt object impacts. However, such a strategy takes no account of the often complex injury mechanisms within the body produced by the impact. Whilst there exists a fair degree of medical disagreement over precise injury mechanisms, it is clear that soft tissue injuries resulting from impact are due to a complex relationship between the type of impact and the nature of loads generated, the impact site and the material properties of the body at the impact site, degree of restraint on the body etc. For example, in the case of head impacts a number of possible injury mechanisms may be postulated and several of these are summarised below. Similar mechanisms can be postulated for damage to vital organs within the body cavity.

A severe blow to the head will cause the skull to accelerate rapidly, inertial effect will cause the brain to strike the accelerating skull with possibility of local injury. In addition, a blow to the head could result in a stress wave/pressure wave travelling through the brain. This wave would result in high, localised, shear stresses deep inside the brain leading to rupture of blood vessels. A stress wave travelling through the brain will undergo multiple reflections at the rear brain/skull interface, interference between waves could result in localised tensile stresses. These tensile stresses could, if high enough, tear brain tissue apart resulting in severe damage at the rear of the brain, remote from the point of impact. An impulsive shock is characterised by a broad continuous frequency spectrum and a further mode of damage may arise if specific frequencies cause the brain to resonate within the skull cavity leading to both localised and remote injuries. A blow to the head could also result in tri-axial forces producing both translation and rotation and as a result differential movement between the brain and brain stem could occur.

SUMMARY OF THE INVENTION

It is an object of the invention to provide a material and method for the protection of the human head and body from soft tissue damage resulting from impulsive loading which takes account of these injury mechanisms to produce more effective protection from blunt object impacts than protection based solely on minimising the gross displacement produced by the impact.

According to a first aspect of the invention, a material for the protection of the human head or body from soft tissue damage caused by an impacting object comprises at least two layers of viscoelastic polymeric materials, including at least one first layer of a first viscoelastic polymeric material selected to be substantially matched in acoustic impedance to the impacting object and at least one second layer of a second viscoelastic polymeric material, positioned in use between the first layer and the head or body to be protected, selected to produce a large mismatch in acoustic impedance between the first layer(s) and the human head or body.

Preferably, for most impact situations the mismatch provided by the second layer or layers will be at least about 2 MRayls. However, as the purpose of the material is to act as an acoustic wave filter to control the magnitude and frequency content of the transmitted stress components, the mismatch need only reach this minimum within frequency bands which could be potentially injurious to the part of head or body under protection.

Stress wave coupling between the body and the impactor is found to be a significant cause of soft tissue injury following impact which cannot be attributed to gross displacement alone. The coupling of energy between two media depends on the relative acoustic impedance between the two media. The energy associated with an impact initially consists of translational kinetic energy. At the time of impact some of this kinetic energy will be converted to potential energy in the form of a pressure pulse resulting in a high amplitude non-linear acoustic wave entering the internal tissue of the brain or body cavity. The invention seeks to control the magnitude and frequency content of this pressure wave by the use of materials functioning as acoustic wave filters.

Use of the layered material in accordance with the invention so that it lies between the impactor and body, for example in the form of an article of protective clothing or headgear, can reduce the stress wave coupling. The layer or layers of the second material providing the large acoustic impedance mismatch between the layer or layers of the first material and the head or body acoustically decouple(s) the impactor from the body and minimise damage resulting from stress wave coupling. The layer or layers of the first material which are substantially matched in acoustic impedance to the impactor absorbs much of the kinetic energy of the impact converting it to potential energy thus maximising the energy absorption capability of the layered material as a whole. Materials are selected from known viscoelastic polymeric acoustic materials, and suitable selections will be readily apparent to those skilled in the art.

Where stress wave coupling alone is the predominant injury mode and there is no requirement to control the reflected energy (for example, for blast protection where the potential (high amplitude stress wave) energy tends to be much greater than the kinetic (blast wind) energy) the material may be arranged with the decoupling layer or layers outermost from the body and the absorbing layer or layers innermost and selected to be substantially matched in acoustic impedance to the body to maximise energy absorption. However, the situation differs for blunt object impacts. Before impact a blunt projectile contains only translational kinetic energy. On impact some of this energy is converted to potential energy in the form of a pressure wave. Some of the energy will remain as translational kinetic energy causing displacement of the head or body after impact, a particular problem for head impacts where the resultant rapid acceleration of the head can cause the components within the skull to be compacted against it allowing stress waves to be set up in the brain.

Thus, for blunt impacts, it is likely to be preferred that the impact energy is first coupled to the absorbing medium, so that the layer of viscoelastic polymeric material selected to be substantially matched in acoustic impedance to the impacting object will be the outermost from the head or body to be protected. This layer ensures that most of the incident energy is transmitted to the absorbing material, thus serving to enhance the conversion of kinetic energy to potential energy and thereby reduce the rapid acceleration of the head. The impedance mismatch between the outer layer and the head or body ensures that any energy not absorbed by the outer layer is decoupled at and largely reflected back from the material interfaces back into the outer layer for absorption via a second pass through that layer. In principle the transmission of energy could be controlled by the use of mass/spring/damper systems. However by using materials based on a viscoelastic polymer matrix both the required stiffness and damping can be incorporated into a single material resulting in a much more practical protective material.

The invention is of particular applicability to the provision of protection for the human head. Stress wave coupling to produce a pressure wave within the brain and the absorption of the resultant pressure wave energy within in the brain is a potentially significant source of damage and is likely to be exacerbated by multiple reflections at the internal brain/skull interface and the possibility of resonance effects, both of which are of particular potential significance given the properties of skull and brain tissue. Thus, a particular embodiment of the invention comprises a protective helmet incorporating the protective layered material hereinbefore described. Examples of uses for the resultant lightweight helmet include automotive applications, cycling helmets, rugby scrum caps, and protective headgear for boxing and like weaponless combat based contact sports.

Although in most circumstances it is clear that the protective material is conveniently applied to the head, it will be appreciated that in principle the protective material may be applied to the impactor and still produce the necessary decoupling on impact. A particular application of this arises in the field of boxing and similar weaponless combat based contact sports. In professional boxing, protective headgear is not used in competition. By analogy, the material according to the invention can in this case be used in an embodiment of the invention comprising a glove for use in combat based sports, for example a boxing glove, incorporating the protective material hereinbefore described. Similar principles could be applied to footwear in sports allowing foot/head contact and it is intended that "glove" is here read broadly to cover all such like protective covering.

BRIEF DESCRIPTION OF THE DRAWINGS

The invention will now be described by way of example only with reference to the drawings in which.

DETAILED DISCUSSION OF PREFERRED EMBODIMENTS

Figure 1:
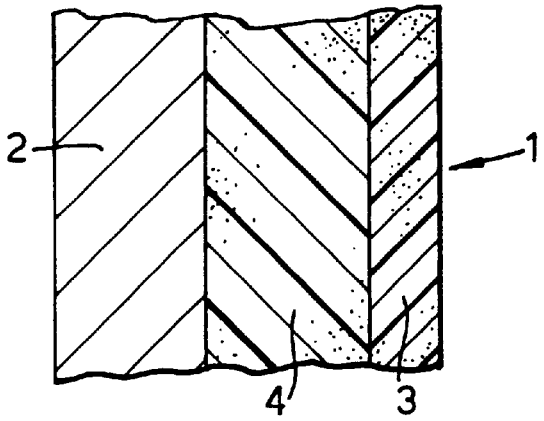
FIG. 1 shows a cross-section through a material according to the present invention.

Referring now to FIG. 1, there is shown in cross-section a material according to the present invention. The impact direction is shown by the arrow 1 and an impacting object from this direction will first encounter viscoelastic polymeric material layer 3. This layer of viscoelastic polymeric material is selected to be substantially matched in acoustic impedance to the impacting object. A second viscoelastic polymeric material layer 4 is placed between the first viscoelastic polymeric material layer and the head or body 2. The second viscoelastic polymeric material layer is selected to produce a large mismatch in acoustic impedance between the first layer and the head or body. Both viscoelastic polymeric material layers may comprise more than one material.

Figure 2:
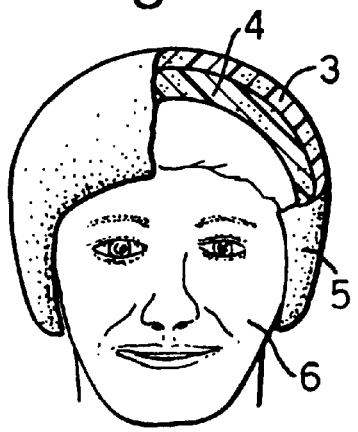
FIG. 2 shows a perspective view of an embodiment of the present invention.
Figure 5:
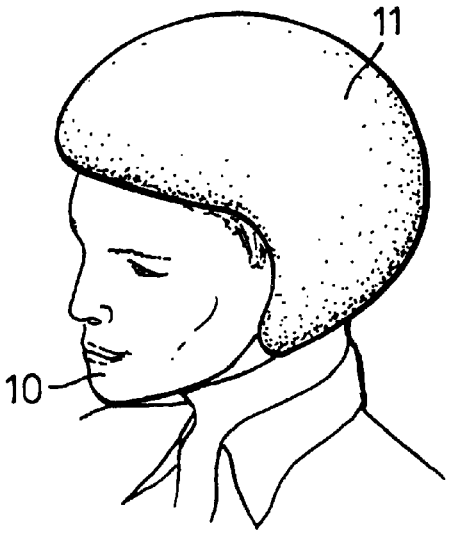
FIG. 5 shows a side view of a helmet referred to in FIG. 2.

FIG. 2 shows a helmet 5 according to the present invention. A piece of the helmet has been removed to show the first and second viscoelastic polymeric material layers 3 and 4 positioned so that the first viscoelastic polymeric layer is impacted by the impacting object with the second viscoelastic polymeric layer being positioned between the first viscoelastic polymeric material layer and a human head 6. FIG. 5 shows a side view of a helmet referred to in FIG. 2 with a helmet 11 placed on a human head 10.

Figure 3:
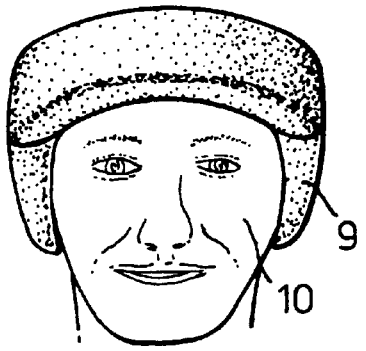
FIG. 3 shows protective headgear according to the present invention.

FIG. 3 shows protective headgear according to the present invention. The protective headgear 9, placed on a human head 10, is substantially similar in construction to the helmet shown in FIG. 2 and utilizing the layered structure indicated in FIG. 1.

Figure 4:
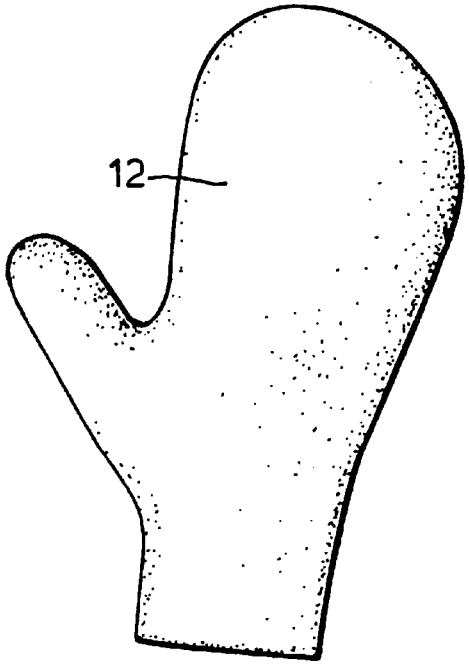
FIG. 4 shows a glove according to the present invention.

FIG. 4 shows a glove according to the present invention. The glove 12 is constructed from the material detailed in FIG. 1. The head or body 2 shown in FIG. 1 would be a hand placed inside the glove.

According to a further aspect of the invention, a method of protection of the human head or body from soft tissue damage caused by an impacting object comprises interposing between the human head or body and an impacting object at least two layers of viscoelastic polymeric material, including at least one first layer of a first viscoelastic polymeric material selected to be substantially matched in acoustic impedance to the impacting object and at least one second layer of a second viscoelastic polymeric material positioned between the head or body and the layer or layers of the first material, selected to produce a large mismatch in acoustic impedance between the human head or body and the first layer.

Human impact injuries are often frequency specific and if the energy within the injurious frequency band can be effectively decoupled from the body then the risk of fatal injury can be reduced. The method of protection can be refined to maximise protection for a particular impact event by preceding with the method with the additional steps of analysing the damage profile for the particular impact event in the frequency domain, determining the particular stress wave frequency band producing maximum tissue damage, selecting the material for the at least one first layer of a first viscoelastic polymeric material to have a minimum mismatch in acoustic impedance the particular stress wave frequency band, and selecting the material for the at least one second layer of a second viscoelastic polymeric material to have a maximum mismatch in acoustic impedance with the impactor and the head or body at the particular stress wave frequency band. In this case the second layer is preferably configured to exhibit quarter wave resonance at the particular stress wave frequency band to further enhance its energy absorbing capabilities within that band.

Materials are selected from known acoustic materials having the desired dynamic properties. They will be polyurethane materials with additives, including fillers and possibly fibres, to optimise complex moduli, loss tangents, densities, and complex phase velocities. Suitable materials will be familiar to those skilled in the art.

The method is generally applicable to blunt object impacts, in which a significant injury mechanism arises from the direct coupling of the impact energy to the body. The kinetic energy of the impactor is converted to potential energy and transmitted straight through to the vital organs. If the energy within the injurious frequency bands can be effectively decoupled from the body then the effects of the impact can be reduced. This is true in the case of a boxer hitting his opponent. If the energy carried by the punch can be decoupled and absorbed within the glove or protective headgear then the risk of serious injury can be reduced.

What is claimed is:

1. A material for the protection of the human head or body from soft tissue damage caused by an impacting object comprises at least two layers of viscoelastic polymeric material, including at least one first layer of a first viscoelastic polymeric material selected to be substantially matched in acoustic impedance to the impacting object and at least one second layer of a second viscoelastic polymeric material, characterised in that the layer or layers of the second material are positioned between the first material and the head or body, and are selected to produce a large mismatch in acoustic impedance between the first layer and the human head or body.

2. A material for the protection of the human head or body from soft tissue damage caused by an impacting object as claimed in claim 1 characterised in that the large mismatch in acoustic impedance provided by the second layer is at least 2 MRayls.

3. An article of protective clothing comprising the material in accordance with claim 1.

4. A protective helmet comprising the material in accordance with claim 1.

5. Protective headgear for use in combat based sports comprising the material in accordance with claim 1.

6. A glove for use in combat based sports comprising the material in accordance with claim 1.

7. A method of protection of the human head or body from soft tissue damage caused by an impacting object comprises interposing between the human head or body and an impacting object at least two layers of viscoelastic polymeric material, including at least one first layer of a first viscoelastic polymeric material selected to be substantially matched in acoustic impedance to the impacting object and at least one second layer of a second viscoelastic polymeric material, positioned between the first material and the head or body selected to produce a large mismatch in acoustic impedance between the human head or body and the first layer.

8. The method of protection according to claim 7 preceded by the steps of analysing the damage profile for the particular impact event in the frequency domain, determining the particular stress wave frequency band producing maximum tissue damage, selecting the material for the at least one first layer of viscoelastic polymeric material to have a minimum mismatch in acoustic impedance at the particular stress wave frequency band, and selecting the material for the at least one second layer of viscoelastic polymeric material to have a maximum mismatch in acoustic impedance at the particular stress wave frequency band.

9. The method of protection according to claim 8 wherein the second layer is configured to exhibit quarter wave resonance at the particular stress wave frequency band.

* * * * *